United States Patent [19]

Hager et al.

[11] 4,165,045

[45] Aug. 21, 1979

[54] DISINTEGRATING MACHINE FOR FOOD

[76] Inventors: Jürgen Hager, 5609 Hückeswagen-Oberdorp; Walter Vieth, Arnzhausen 7, 5679 Dabringhäusen, both of Fed. Rep. of Germany

[21] Appl. No.: 814,264

[22] Filed: Aug. 3, 1977

[30] Foreign Application Priority Data

Sep. 14, 1976 [DE] Fed. Rep. of Germany ..... 7628629
Nov. 5, 1976 [DE] Fed. Rep. of Germany ..... 2650690

[51] Int. Cl.[2] ..... B02C 18/22
[52] U.S. Cl. ..... 241/282; 241/283
[58] Field of Search ..... 241/280, 282, 283; 83/417, 437

[56] References Cited

U.S. PATENT DOCUMENTS

| | | | |
|---|---|---|---|
| 2,860,678 | 11/1958 | Condon et al. | 241/282 X |
| 3,160,351 | 12/1964 | Shelton, Jr. | 241/282 X |
| 3,690,572 | 9/1972 | Thumm et al. | 241/282 X |
| 3,734,419 | 5/1973 | Cryderman | 241/282 |
| 4,051,757 | 10/1977 | Reifenhauser et al. | 83/437 X |

*Primary Examiner*—Howard N. Goldberg

[57] ABSTRACT

A machine for cutting blocks of frozen meat wherein the meat blocks are pushed in contact with a cutter drum or under a knife bar by means of a pusher provided with a rearwardly extending plate, a desk covering the plate in its position remote from the cutter drum or knife bar, the plate forming an intermediate support for meat blocks during the forward movement of the pusher.

6 Claims, 5 Drawing Figures

DISINTEGRATING MACHINE FOR FOOD

BACKGROUND OF THE INVENTION

The present invention relates to a machine for disintegrating blocks of frozen food and in particular to a machine for cutting blocks of frozen meat by means of a cutter drum or by means of a guillotine-like knife bar. The company General Machinery Corp., Sheboygan, Wisconsin, has sold under the designation "Hydroflaker" a machine of this type comprising a support table extending from the periphery of a cutter drum in a substantially horizontal position. A pusher member is reciprocatingly movable across the table back and forth with respect to the drum so to convey meat blocks deposited on the table in contact with the drum. The pusher is hydraulically driven, each stroke being manually initiated. Laterally of the table, an auxiliary platform is provided whereon an operator may unpack the meat blocks which are usually delivered in bags or boxes, each block being protected by a plastic skin to be removed prior to the cutting operation. An unpacked block is shifted from the platform unto the table, and upon actuation of the hydraulic drive means, the cutting operation will begin.

It is evident that the machine will be used in the most economic manner under the provision that the operator may unpack just one meat block within the time period to disintegrate the preceeding one so that the pusher may reciprocate continuously. Due to the inherent differences between individual blocks, however, the time necessary to unpack them will vary and so either the machine will idle for some time or the operator has to wait for the return of the pusher. But even under ideal conditions, the continuous observation of the pusher will require a high degree of concentration of the operator who, therefore, is subjected to stress.

In view of the problem discussed above, it is the object of the present invention to provide a machine for cutting frozen meat blocks wherein the machine design permits an operator to be concerned only with the unpacking job, while any periodical variations of time necessary to deliver an unpacked block to the machine are absorbed or buffered by the machine, permitting the operation thereof in a continuous manner.

BRIEF DESCRIPTION OF THE INVENTION

In accordance with the invention, the machine comprises a frame carrying a support preferably designed as a smooth table. At one end of the table, cutting means are disposed, either a rotating drum or a knife bar reciprocating substantially perpendicular with respect to the smooth support surface. Movable across the table, there is a pusher having a plate movable therewith, the plate extending from an upper edge of the pusher away from the cutting means. In the position of the pusher, most remote from the cutter drum or knife bar, it is completely covered by a stationary desk, and so is, of course, the plate. The operator will use the desk as a working platform, and each unpacked block is simply shifted along the desk in direction of the cutting means, regardless of the actual position of the pusher. If the pusher is just in its rearmost position under the desk, the block will slide immediately onto the smooth support surface and will be pushed upon the next stroke of the pusher in direction to the cutter drum or under the knife bar in contact with a stop disposed therebeyond. If, otherwise, the pusher is implementing a forward or backward stroke, the block will slide unto the plate extending from the pusher backward and will rest thereon until the pusher returns under the desk. The block will then abut the front edge of the desk and the plate will slide backward under the block until the latter will fall down unto the support so to be pushed forward upon the next forward stroke of the pusher.

This concept not only permits simplification of the operator's job, but also permits disposition of the pusher drive means under the plate and the desk, respectively, avoiding complicated transmission means to drive the pusher, as is the case in the known machine discussed above wherein chain drives are provided.

Several embodiments of the invention will be explained in detail hereunder with reference to the accompanying drawings.

In all the drawings, elements with which an expert is readily familiar are omitted for sake of clarity in order to demonstrate the inventive features, the drawings are thus to be considered as mere schematic illustrations.

DESCRIPTION OF THE EMBODIMENTS

Figure 1:
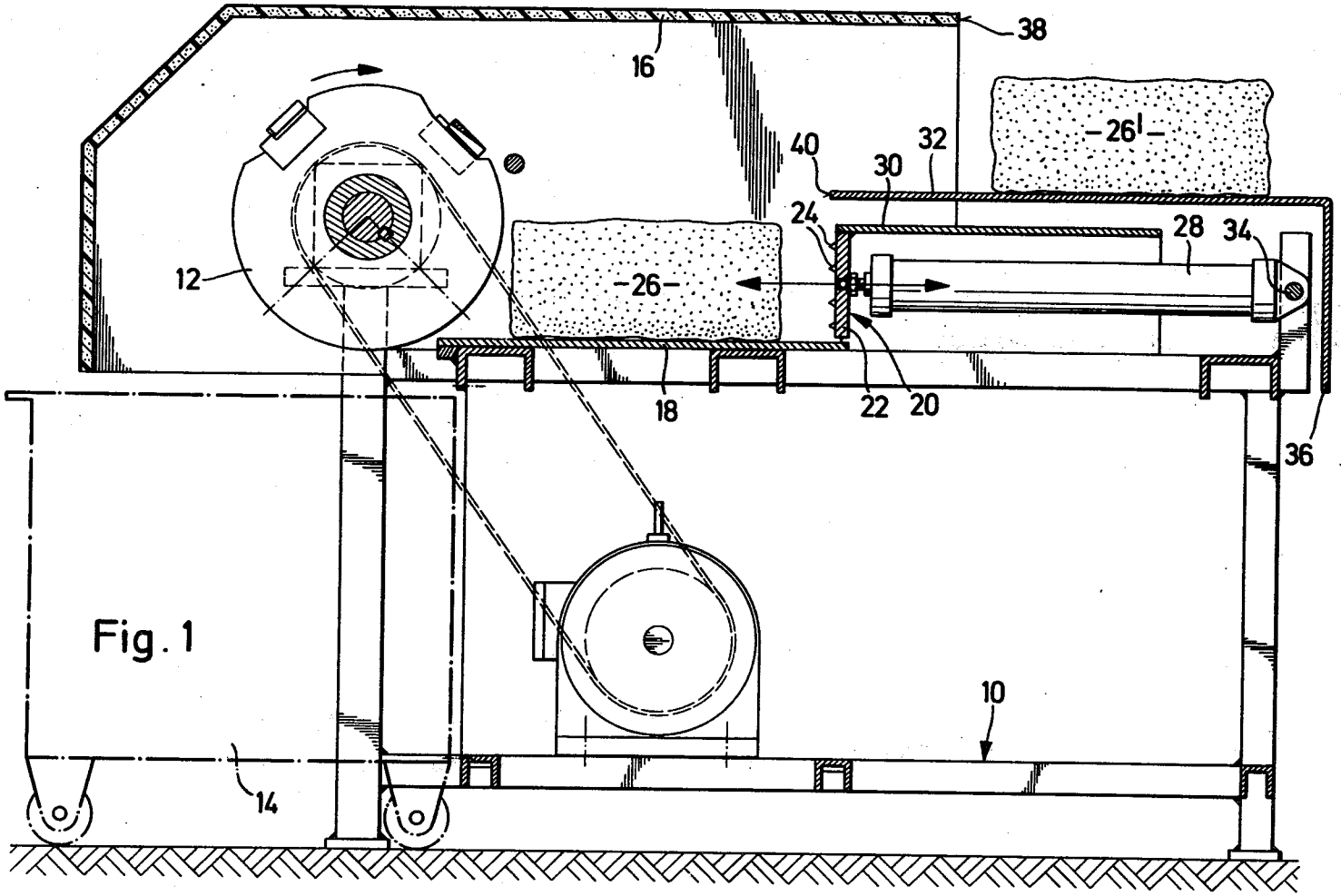
FIGS. 1–4 each show a longitudinal section view of an embodiment of a machine according to the invention wherein a cutter drum is provided.

As shown in FIG. 1, the machine comprises a frame 10, on which in a manner not shown in detail a disintegrating drum 12 is mounted. Drum 12 may be driven to rotate about a horizontal axis. With regard to the design of the drum, it is to be mentioned that it may be quite conventional, and applicants may refer to German Patent Application specification DT-OS 24 51 313, published May 6, 1976 in the name of the assignee.

Frame 10 has at the drum outlet a tunnel to receive a carriage 14 or another container for meat parts falling down under the influence of gravity and centrifugal forces after being cut from a block of frozen meat by the drum. A hood 16 confines the drum and defines in horizontal direction—righthand in FIG. 1—a feeding tunnel. From a point adjacent the lowermost part of the drum, a support for meat blocks extends horizontally within said feeding tunnel, the support preferably being the upper surface of a table 18.

A pusher 20 is disposed above table 18 and is driven to a reciprocating movement thereacross and parallel to its extension. Pusher 20 comprises a front wall 22 provided preferably with protruding teeth 24 or the like; these teeth assure proper engagement of each block by the pusher and will prevent tilting of irregularly shaped blocks. With the surface of the front wall 22 opposite the drum, the piston rod of a hydraulic cylinder 28 is in engagement, the other end of the cylinder 28 being fastened to the frame at 34. Cylinder 28 may be fed with other pressurized fluid, too, for example, pressurized air.

The drawing shows the pusher 20 in its position most remote from the cutter drum. The stroke of cylinder 28 is such that the pusher may be shifted short of the drum surface. The fluid control may be switched by means of end switches with which an expert, of course, is familiar, and which are not illustrated for this reason.

From the upper edge of front wall 22, a plate 30 extends horizontally away from the drum, i.e., to the right in the drawing. The extension of plate 30 is at least equal to the stroke of cylinder 28 and thus equal to the pusher path, the plate moving together with the pusher.

An unpacking platform or desk 32 is stationarily mounted on frame 10. It may be designed such that it is easily removable to permit cleaning of the machine. Desk 32 is above cylinder 28 and plate 30 and has a front edge 40 slightly protruding beyond front wall 22 of pusher 20, when the latter is in its most remote position with respect to drum 12. Backwardly, desk 32 extends beyond abutment stop 34 of cylinder 28. Skirt 36 of desk 32 may be provided with control switches for the machine (not shown). The forward portion of desk 32 adjacent the drum is covered by hood 16, edge 38 thereof preferably being provided with means to mount a curtain or the like (not shown); such a curtain prevents meat particles to be thrown through the feeding tunnel in desk direction.

A block 26' of frozen meat may be unpacked on desk 32 while drum 12 disintegrates a previously unpacked block 26 pushed against the drum by pusher 20. Each block once unpacked is pushed forward by the operator into the feeding tunnel, the block either falling directly unto table 18 or unto plate 30, depending upon the instantaneous position of pusher 20. In the former case, the block will assume the position of block 26 illustrated in the drawing; in the latter case, the block will abut, upon the return stroke of pusher 20, front edge 40 of desk 32, and plate 30 will slide under the block to the right in the drawing. The block will then first fall down with its leading end unto table 18 and finally fall also with its trailing edge, once front wall 22 has moved completely under desk 32.

It is to be noted that, in case of smaller blocks, several of them will be accommodated on plate 30, in this case eventually more than one operator being charged with the unpacking. The speed of the machine may be adjusted such that it may operate continuously, i.e., cylinder 28 will be automatically switched in each of its end positions so to make pusher 20 perform a continuous reciprocative motion. Means are provided, however, to actuate the cylinder to perform individual back and forth strokes, too. The return stroke will always be automatically actuated upon the pusher having reached its position most proximate to drum 12.

Continuous operation of the machine is considered to be most economical, and it will be achieved the easier the greater the buffer capacity of the machine will be. There is, however, a limit set by the space requirements.

Figure 2:
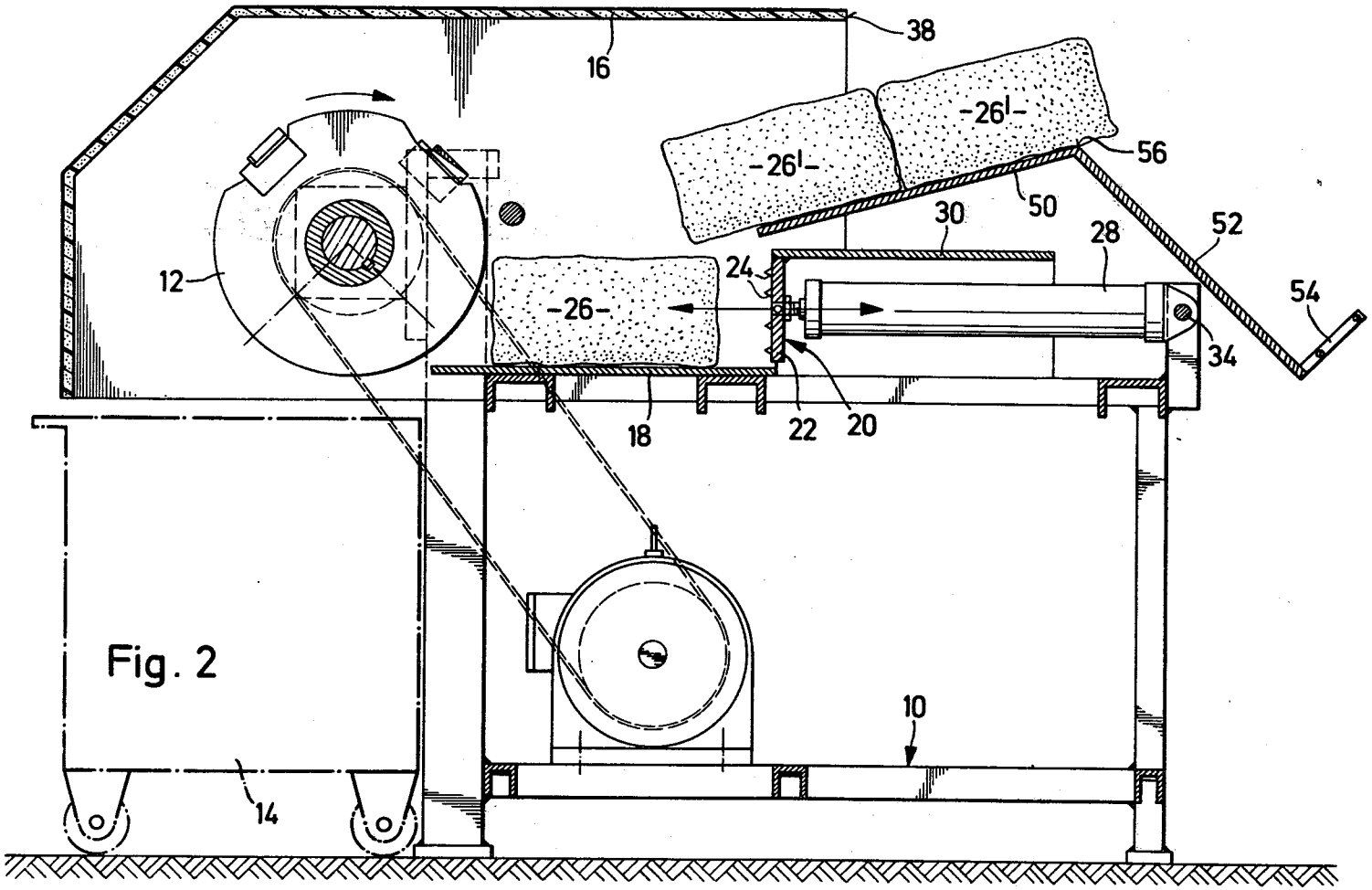
Figure 3:
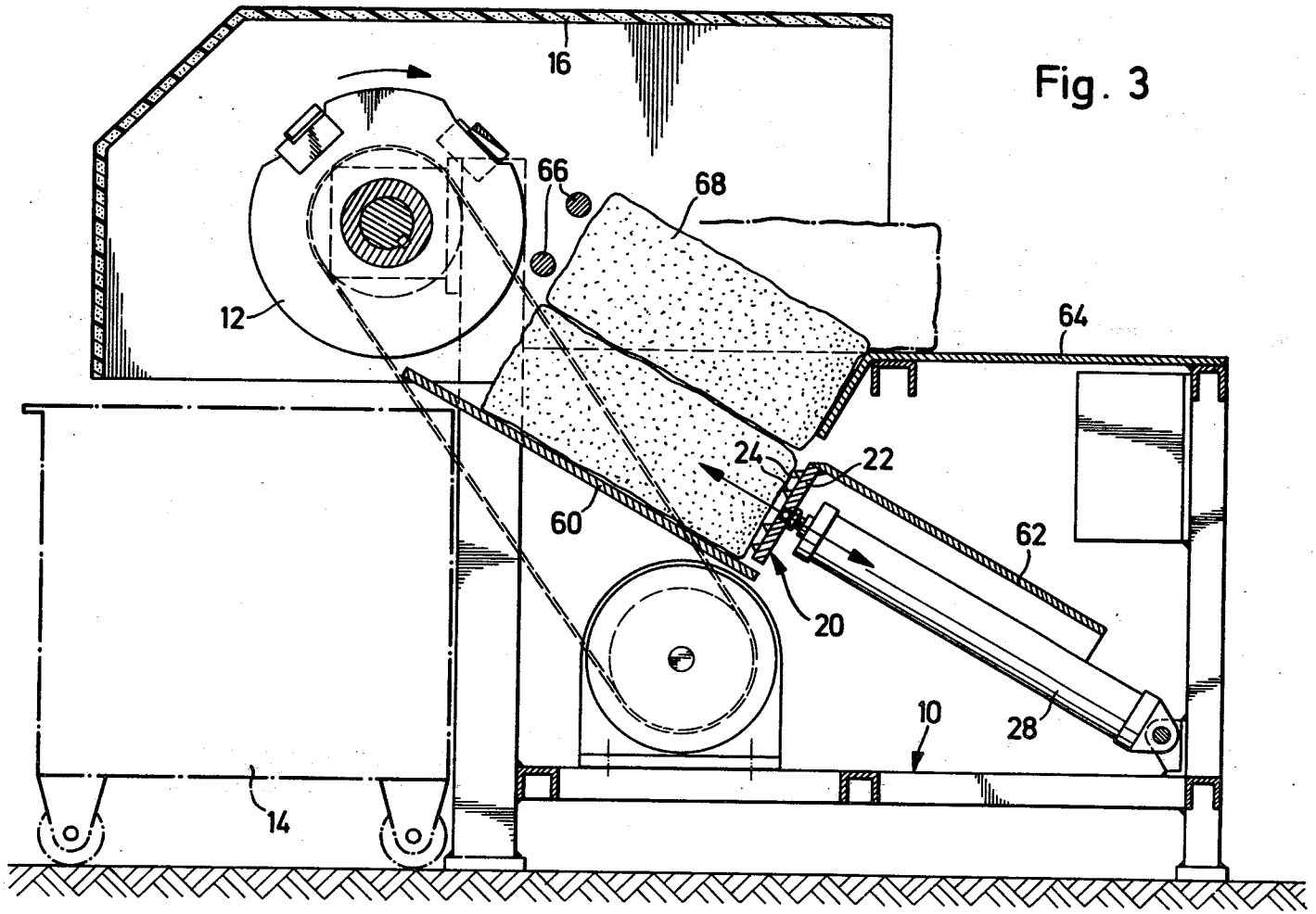
Figure 4:
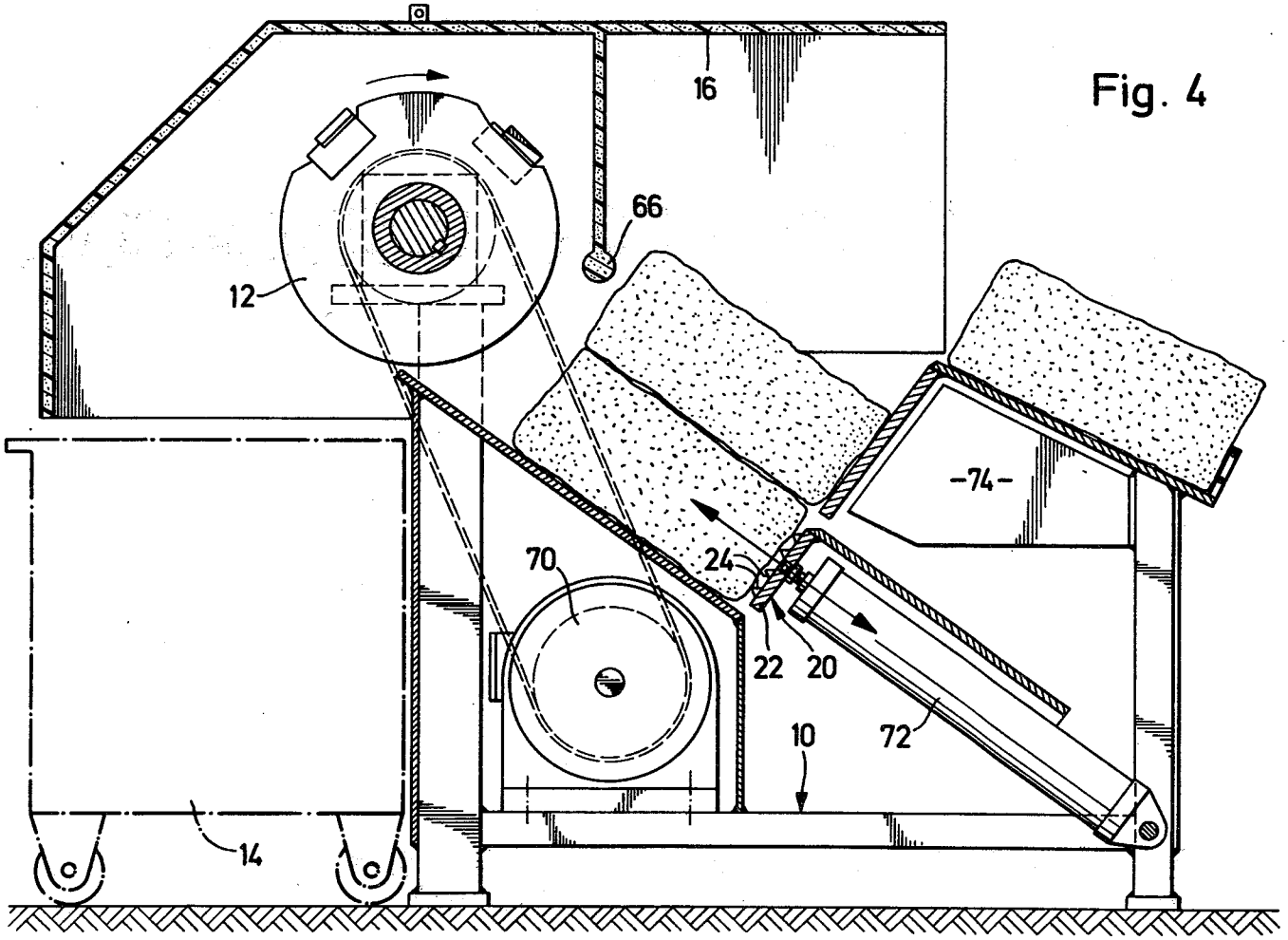

The embodiments illustrated in FIGS. 2–4 are designed under such considerations. For sake of simplicity, but those features will be discussed by which these machines distinguish over the design of FIG. 1, equivalent parts being designated with identical reference numerals.

In FIG. 2, it is to be noted that the desk comprises two portions inclined against the horizontal plane by different and opposite angles. Portion 50 pointing to the drum 12 permits sliding of blocks unto table 18 or plate 30, as the case may be. Portion 52, on the contrary, is oppositely inclined so that an operator has it in a convenient position for the unpacking job, the block being supported by a stop 54 provided at the lowermost edge of portion 52. This design has the advantage that the height through which the block must be lifted up to stop 54 may be held at a minimum, while pushing the block over "roof edge" 56 of the desk between the two portions thereof will require only moderate power.

An extremely short dimension of the machine will be possible if the pusher is disposed as illustrated in FIG. 3, such that its stroke path extends along an inclined slope upwardly to the drum 12. Support 60 is parallel to the pusher path, and parallel again thereto is plate 62. Desk 64, on the contrary, extends substantially horizontally. Stop bars 66 prevent simultaneous feeding of the block on support 60 and a second block 68.

The machine shown in FIG. 4 is provided with features discussed above with reference to FIGS. 2 and 3. The pusher path is even more inclined than in FIG. 3, while the desk has the two portions discussed with reference to FIG. 2. This machine is not only quite short, but also the job of the operator is facilitated. In spite of the limited space available under the components so far described, motor 70 to drive the drum, cylinder 72 to drive the pusher and a control subassembly 74 may all be accommodated within the frame.

Figure 5:
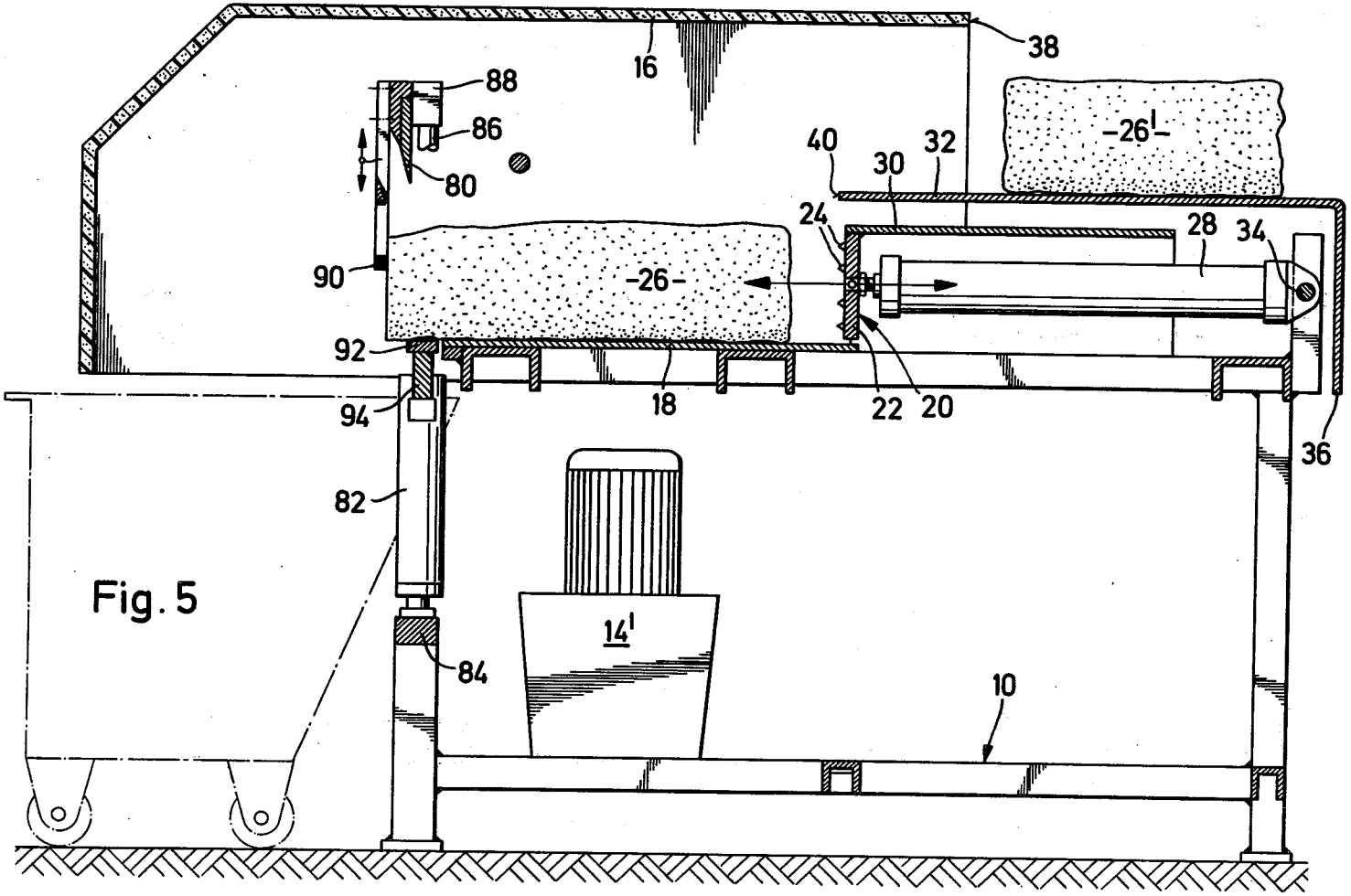
FIG. 5 is a longitudinal section view of a machine according to the invention wherein a knife bar cutter is used.

The machine of FIG. 5 is equipped with a knife 80 driven to a reciprocating guillotine-like movement by hydraulic of pneumatic cylinder units 82, fed with pressurized fluid by a motor-pump-unit 14'; such units are available on the market and need not be discussed in detail. Cylinders 82 are supported on transverse bar 84 of frame 10. Their piston rods 86 (shown partly broken away) are connected to a knife bar 88 which carries, in addition to knife blade 80 a stop grid 90. Knife 80 cooperates with a stationary counter knife 92 in turn mounted by means of a base 94 on frame 10. So far, the machine design is known per se.

It is, however, improved by the feeding or conveying means of the invention, and these are identical to those discussed above with reference to FIG. 1, and for this reason the same reference numerals apply.

What we claim is:

1. A machine for cutting blocks of frozen meat, the machine comprising a frame, a support mounted on said frame, cutting means mounted on said frame adjacent one end of said support, said cutting means being driven to a cutting motion of predetermined direction, a pusher member moveable across said support between a first position remote from said cutting means and a second position adjacent said cutting means, said pusher member having a front wall facing said cutting means and being spaced, in said first pusher member position, from said cutting means a predetermined distance for accommodating a block of meat to be cut, said pusher member having further plate means extending from an upper edge of said front wall in a direction pointing away from said cutting means, a stationary desk being mounted on said frame and covering said pusher member front wall and plate means in said first position thereof.

2. A machine as set forth in claim 1 wherein said pusher member is substantially horizontally movable, wherein said support comprises a substantially horizontal support table, wherein said plate means extends substantially horizontally and wherein said stationary desk has a substantially horizontal upper surface.

3. A machine as set forth in claim 1 wherein said support and said plate means extend inclinedly downwardly as seen from said cutting means and wherein said desk is substantially horizontal.

4. A machine as set forth in claim 1 wherein said support and said plate means extend inclinedly downwardly as seen from said cutting means and wherein said desk comprises a first portion extending, from an uppermost edge of said desk, downwardly in direction to said cutting means and a second portion extending from said uppermost edge away from said cutting means and downwardly, its lowermost end being provided with stop means.

5. A machine as set forth in claim 1 wherein fluid cylinder drive means are operatively connected to said pusher member, said drive means being disposed under said plate means.

6. A machine as set forth in claim 1 wherein said pusher member is substantially horizontally movable wherein said support comprises a substantially horizontal support table, wherein said plate means extends substantially horizontally, and wherein said desk has a first portion sloping downwardly toward said cutting means and covering said pusher member and said plate means when in said first position, and a second portion extending downwardly away from said cutting means, said second portion having stop means at its lower extremity for a block of meat.

* * * * *